US006808303B2

(12) United States Patent
Fisher

(10) Patent No.: US 6,808,303 B2
(45) Date of Patent: Oct. 26, 2004

(54) READY MIX BATCH HAULER SYSTEM

(75) Inventor: Gene Fisher, Dickinson, ND (US)

(73) Assignee: Suzanne Medley, Lexington, KY (US)

( * ) Notice: Subject to any disclaimer, the term of this patent is extended or adjusted under 35 U.S.C. 154(b) by 85 days.

(21) Appl. No.: 10/392,462

(22) Filed: Mar. 18, 2003

(65) Prior Publication Data

US 2004/0184346 A1 Sep. 23, 2004

(51) Int. Cl.[7] ..... B28C 7/04

(52) U.S. Cl. ..... 366/3; 366/26; 366/38; 366/41

(58) Field of Search ..... 366/3, 8, 10, 16, 366/20, 26, 41, 42, 45

(56) References Cited

U.S. PATENT DOCUMENTS 1,834,670 A * 12/1931 Yett ..... 366/21
2,945,684 A * 7/1960 Soldini ..... 366/26
RE25,386 E * 5/1963 Soldini ..... 366/26
3,306,590 A * 2/1967 Gallagher ..... 366/38
3,385,571 A * 5/1968 Preeman ..... 366/18
4,810,097 A * 3/1989 Stephens ..... 366/9

* cited by examiner

*Primary Examiner*—Tony G. Soohoo

(57) ABSTRACT

A ready mix batch hauler system for efficiently transporting concrete mixing materials to a job site. A batch hauler truck is provided having a storage tank pivotally attached to the frame of the batch hauler truck. The storage tank has a first reservoir for holding particulate material and a second reservoir for holding cement. The user positions the batch hauler truck such that the rear discharge of the storage tank is positioned near the front discharge of a front end discharge truck mixer and elevates the storage tank. A first auger draws the cement into the second reservoir through an opening and a second auger draws the mixture of the cement and particulate material through the rear discharge. An alignment structure is preferably utilized for aligning the batch hauler truck with the front end discharge truck mixer.

20 Claims, 6 Drawing Sheets

READY MIX BATCH HAULER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to concrete truck mixers and more specifically it relates to a ready mix batch hauler system for efficiently transporting concrete mixing materials to a job site.

2. Description of the Related Art

Concrete truck mixers have been in use for years. Conventional truck mixers are essentially free fall mixers mounted on a truck chassis. They typically handle either thoroughly mixed concrete or a batch of dry materials where water is added when the truck arrives on site. The size of each mixer ranges from 2.5 CY to 12 CY.

Truck mixers either contain centrally mixed concrete (mixed completely in a stationary mixer and then transferred to another piece of equipment for delivery) or will mix the contents during transport otherwise known as truck mixing. The total volume that a truck can handle is limited to 63 percent of the drum volume. The general cycle time is 70 to 100 revolutions, however, if the materials have been adequately charged into the mixer, uniform concrete should be obtained within 30 to 40 revolutions. The travel distance of a truck mixer can range from six to fifteen miles. This range can be extended by "dry batching" where dry materials are added to the mixer and are delivered to the construction site. Water is added at the construction site to the dry batch with the mixing tank revolving at a mixing speed.

The main problem with conventional truck mixers is that they are expensive to operate and maintain. A further problem with conventional truck mixers is that typically 2–6 truck mixers are required at a job site at one time which requires more than 2–6 truck mixers considering travel time between the job site and the material loading location. A problem with using multiple truck mixers is that a load of mixed concrete may have to be dumped if a problem occurs at the work site that does not allow for the concrete to be properly discharged which is costly and time consuming. Another problem with conventional concrete truck mixers is that specialized projects such as bridges and buildings require the wet concrete to be poured within a specified time after the concrete is mixed which can make such deadlines difficult when traveling to a job site.

While these devices may be suitable for the particular purpose to which they address, they are not as suitable for efficiently transporting concrete mixing materials to a job site. Conventional concrete truck mixers are expensive and inefficient to operate upon remote job sites.

In these respects, the ready mix batch hauler system according to the present invention substantially departs from the conventional concepts and designs of the prior art, and in so doing provides an apparatus primarily developed for the purpose of efficiently transporting concrete mixing materials to a job site.

BRIEF SUMMARY OF THE INVENTION

In view of the foregoing disadvantages inherent in the known types of concrete truck mixers now present in the prior art, the present invention provides a new ready mix batch hauler system construction wherein the same can be utilized for efficiently transporting concrete mixing materials to a job site.

The general purpose of the present invention, which will be described subsequently in greater detail, is to provide a new ready mix batch hauler system that has many of the advantages of the truck mixers mentioned heretofore and many novel features that result in a new ready mix batch hauler system which is not anticipated, rendered obvious, suggested, or even implied by any of the prior art truck mixers, either alone or in any combination thereof.

To attain this, the present invention generally comprises a batch hauler truck having a storage tank pivotally attached to the frame of the batch hauler truck. The storage tank has a first reservoir for holding particulate material and a second reservoir for holding cement. The user positions the batch hauler truck such that the rear discharge of the storage tank is positioned near the front discharge of a front end discharge truck mixer and elevates the storage tank. A first auger draws the cement into the second reservoir through an opening and a second auger draws the mixture of the cement and particulate material through the rear discharge. An alignment structure is preferably utilized for aligning the batch hauler truck with the front end discharge truck mixer.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a ready mix batch hauler system that will overcome the shortcomings of the prior art devices.

A second object is to provide a ready mix batch hauler system for efficiently transporting concrete mixing materials to a job site.

Another object is to provide a ready mix batch hauler system that reduces the number of truck mixers required for a job.

An additional object is to provide a ready mix batch hauler system that reduces the overall costs of performing a concrete job.

A further object is to provide a ready mix batch hauler system that reduces the wear and tear upon a truck mixer.

Another object is to provide a ready mix batch hauler system that avoids the time limitations placed upon specialized concrete projects such as buildings and bridges.

A further object is to provide a ready mix batch hauler system that allows the batch hauler truck to share the hydraulic system of the front end discharge truck mixer thereby reducing the cost of the batch hauler truck.

Another object is to provide a ready mix batch hauler system that properly aligns the batch hauler truck to the front end discharge truck mixer.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
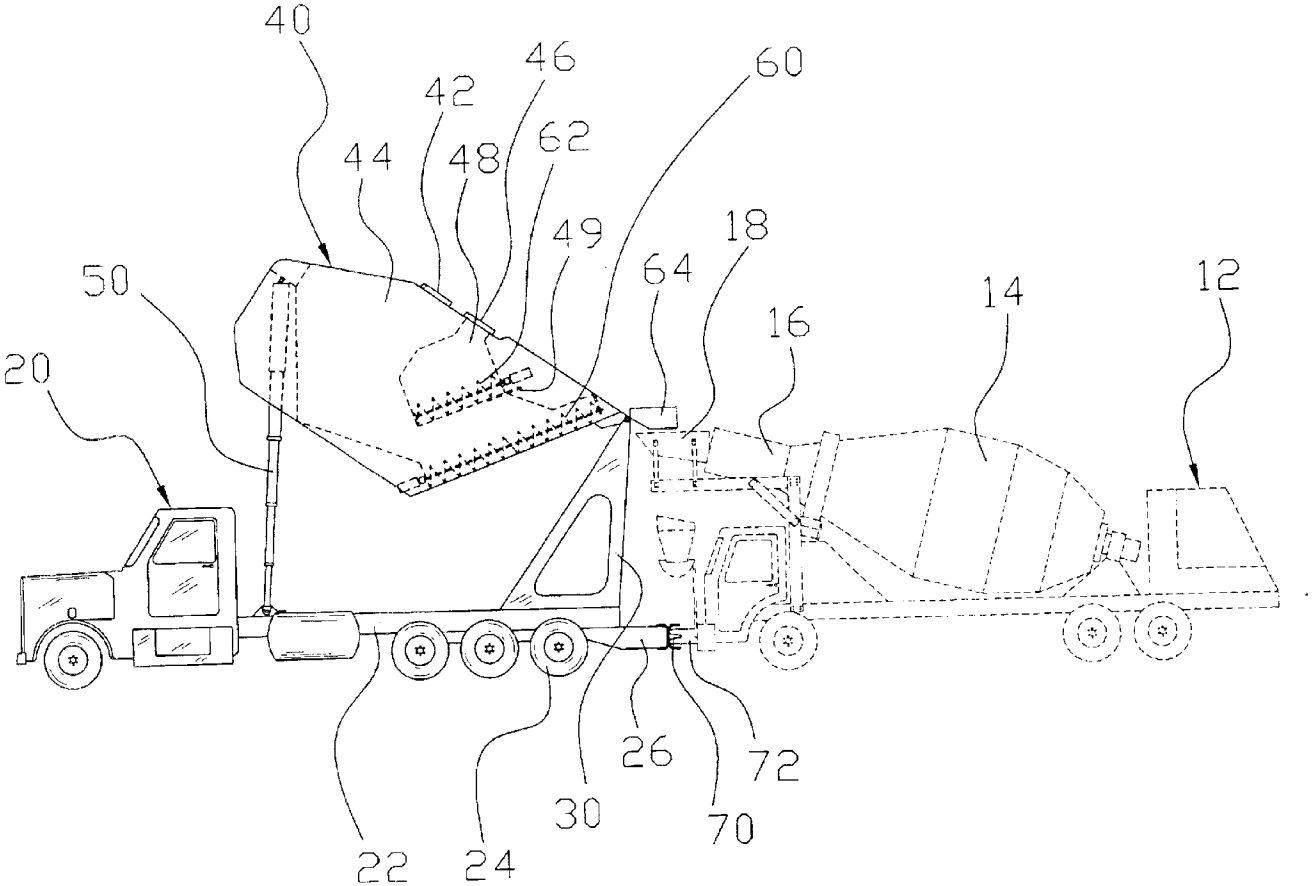
FIG. 1 is a side view of the batch hauler truck positioned adjacent to the front end discharge truck mixer.

Turning now descriptively to the drawings, in which similar reference characters denote similar elements throughout the several views, FIGS. 1 through 6 illustrate a ready mix batch hauler system 10, which comprises a batch hauler truck 20 having a storage tank 40 pivotally attached to the frame 22 of the batch hauler truck 20. The storage tank 40 has a first reservoir 44 for holding particulate material 11 and a second reservoir 48 for holding cement 13. The user positions the batch hauler truck 20 such that the rear discharge 45 of the storage tank 40 is positioned near the front discharge 16 of a front end discharge truck mixer 12 and elevates the storage tank 40. A first auger 60 draws the cement 13 into the second reservoir 48 through an opening and a second auger 62 draws the mixture of the cement 13 and particulate material 11 through the rear discharge 45. An alignment structure is preferably utilized for aligning the batch hauler truck 20 with the front end discharge truck mixer 12.

Figure 5:
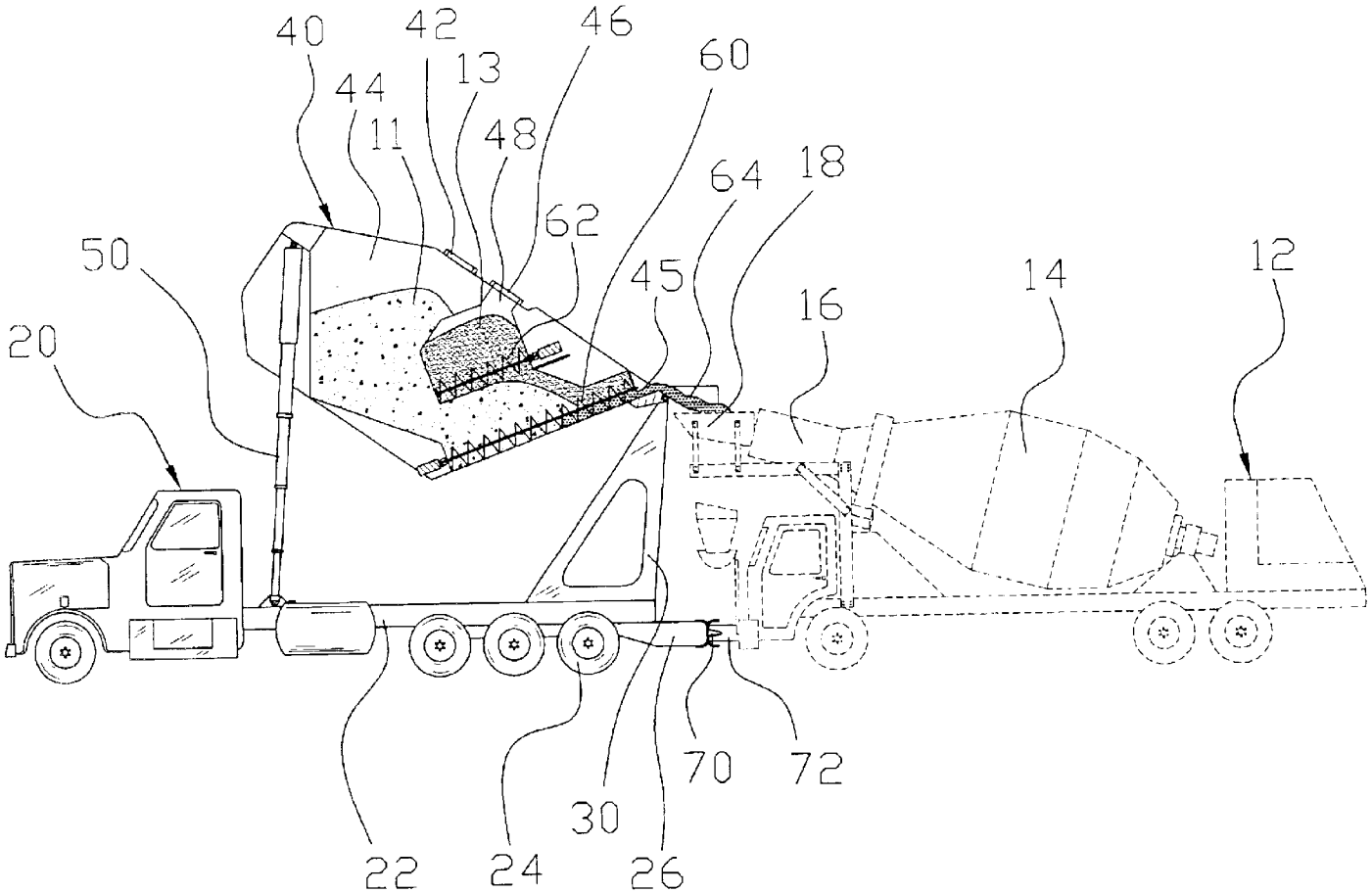
FIG. 5 is a side cutaway view of the batch hauler truck dispensing the particulate material and cement into the front discharge of the front end discharge truck mixer.
Figure 6:
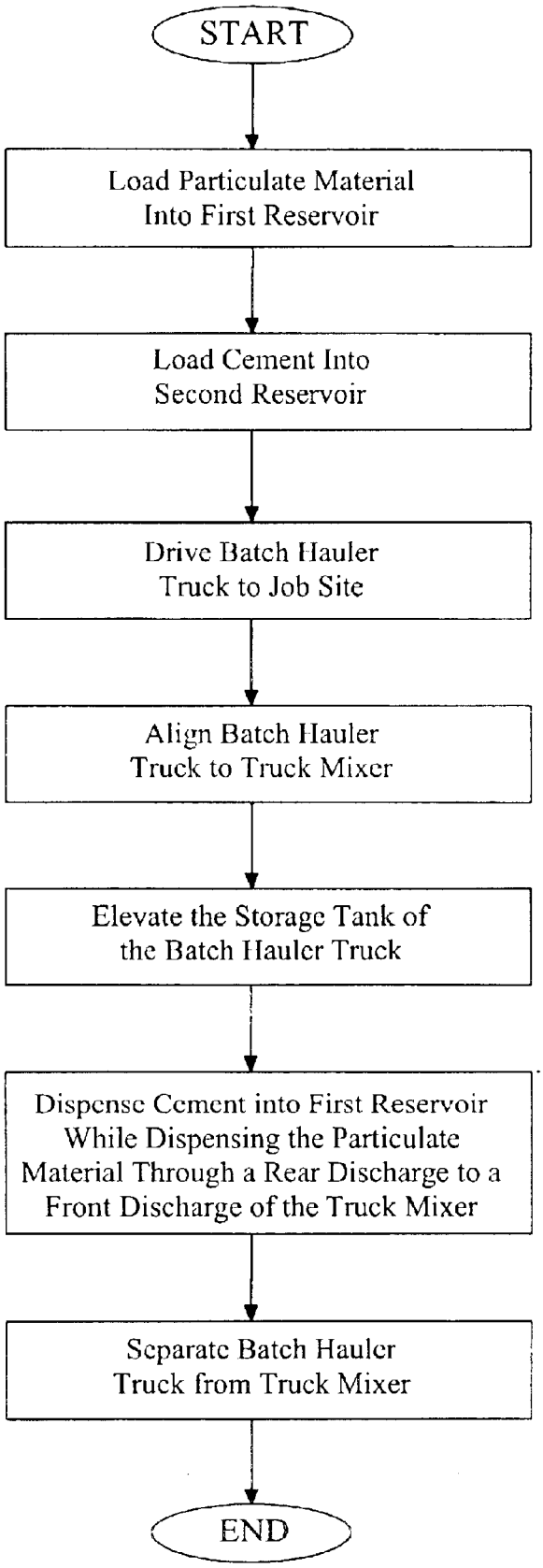
FIG. 6 is a flowchart illustrating the overall functionality and operation of the present invention.

FIGS. 1 and 5 illustrate an exemplary front end discharge truck mixer 12 which are well known in the art of truck mixers 12. The front end discharge truck mixer 12 has a mixing tank 14 which has a front discharge 16 for receiving and discharging material. A front guide chute 18 may be attached near the front discharge 16 for guiding the material into and out from the mixing tank 14 as further shown in FIGS. 1 and 5 of the drawings. Various other truck mixers 12 may be utilized with respect to the present invention and the drawings of the same should not be considered limiting of the present invention.

Figure 2:
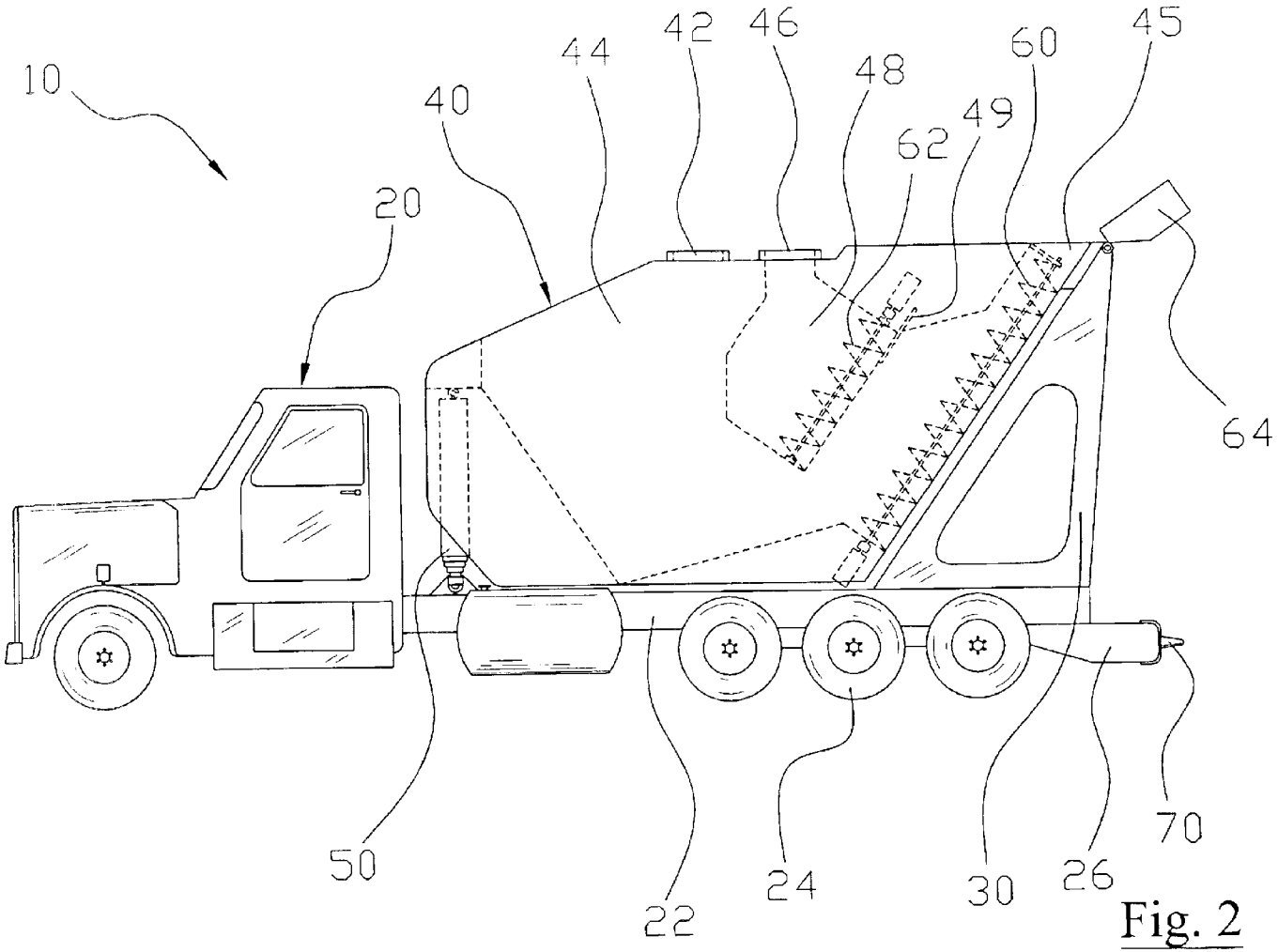
FIG. 2 is a side view of the batch hauler truck.
Figure 3:
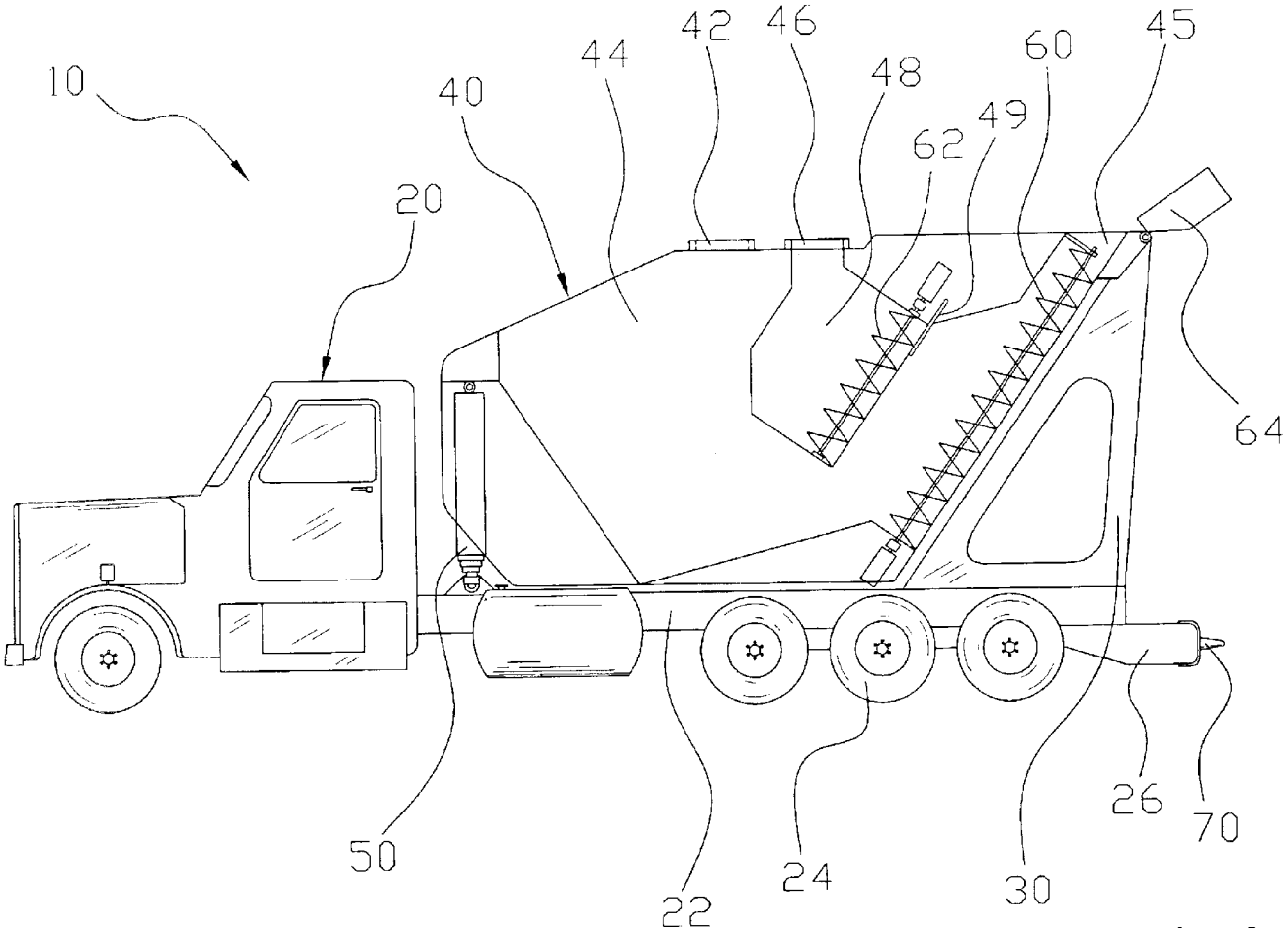
FIG. 3 is a side cutaway view of the batch hauler truck illustrating the first reservoir and the second reservoir of the storage tank.

FIGS. 2 and 3 best illustrate the batch hauler truck 20 which has a frame 22, wheels 24, rear bumper 26, a support structure 30 and a storage tank 40. The frame 22, wheels 24 and rear bumper 26 of the batch hauler truck 20 may be comprised of any well known structure commonly utilized upon trucks and the like. The support structure 30 extends upwardly from a rear of the frame 22 for pivotally supporting the storage tank 40.

The storage tank 40 is comprised of a volume sufficient for carrying a complete load of particulate material 11, cement 13 and possibly water. The storage tank 40 is pivotally attached at the rear thereof to the support structure 30 as best illustrated in FIGS. 2 and 3 of the drawings. At least one main actuator 50 is positioned between the frame 22 and the front of the storage tank 40 for elevating the front of the storage tank 40 as shown in FIG. 5 of the drawings. The main actuator 50 may be comprised of a hydraulic cylinder or other actuator device. Hydraulic pressure to the main actuator 50 may be provided by an independent hydraulic unit upon the batch hauler truck 20 or by fluidly connecting to the existing hydraulic system of the front end discharge truck mixer 12 when positioned adjacent to the front end discharge truck mixer 12.

As best shown in FIGS. 2 and 3 of the drawings, the storage tank 40 preferably has a first reservoir 44 for receiving the particulate material 11 such as but not limited to sand, gravel and the like. A removable first hatch 42 provides access to the first reservoir 44 through a first opening within the storage tank 40 for filling the first reservoir 44.

Figure 4:
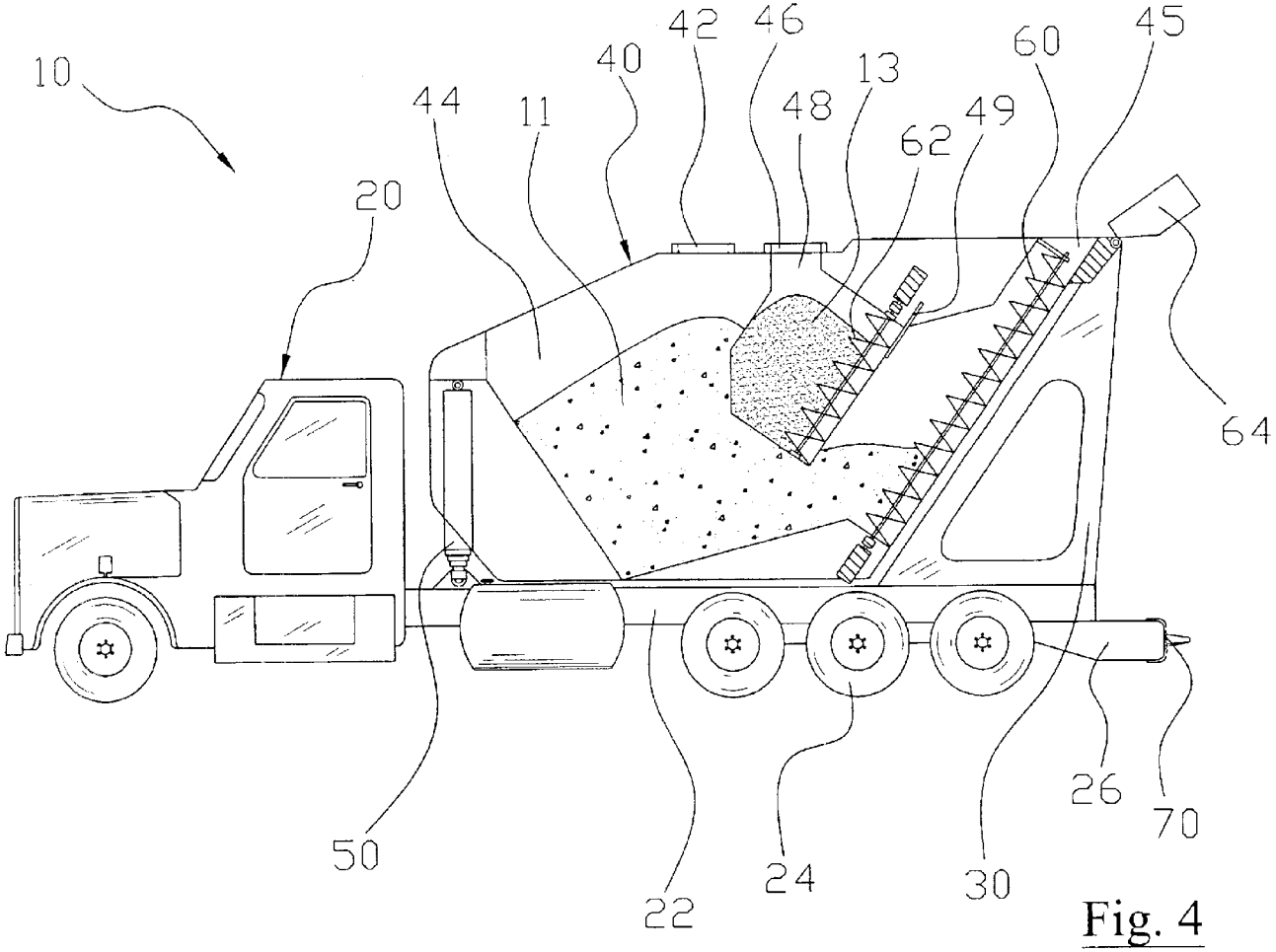
FIG. 4 is a side cutaway view of the batch hauler truck illustrating the first reservoir filled with particulate material and the second reservoir filled with cement.

The storage tank 40 also has a second reservoir 48 for receiving the cement 13 and fly ash material as shown in FIGS. 2 through 4 of the drawings. The second reservoir 48 is accessible by a second hatch 46 through a second opening within the storage tank 40 for filling and the like. The second reservoir 48 is preferably smaller in volume capacity than the first reservoir 44 since a greater volume of particulate material 11 is required compared to the volume of cement 13 required to mix a batch of concrete.

A gate member 49 selectively covers a middle opening between the first reservoir 44 and the second reservoir 48 as shown in FIGS. 3 through 5 of the drawings. The gate member 49 may be manually or mechanically manipulated for opening and closing thereof. The gate member 49 is preferably a sliding structure, however various other gate structures may be utilized to construct the gate member 49.

A second auger 62 is preferably positioned within the second reservoir 48 for drawing the cement 13 toward the middle opening where the cement 13 is combined with the particulate material 11 within the first reservoir 44 as shown in FIGS. 1 through 5 of the drawings. The second auger 62 is rotated by a motor which may be hydraulic or electrically powered. It can be appreciated that the second auger 62 may not be needed to divert the cement 13 into the first reservoir 44 if the angle of the floor in the second reservoir 48 is sufficient for allowing gravity diversion to occur.

As further shown in FIGS. 1 through 5 of the drawings, a first auger 60 is preferably positioned within the first reservoir 44 for drawing the particulate material 11 and the cement 13 outwardly through the rear discharge 45 of the storage tank 40. The first auger 60 is rotated by a motor which may be hydraulic or electrically powered. It can be appreciated that the first auger 60 may not be needed to divert the particulate material 11 and cement 13 through the rear discharge 45 if the angle of the floor in the first reservoir 44 is sufficient for allowing gravity diversion to occur. FIGS. 1 through 5 further illustrate the usage of a rear guide chute 64 attached to the storage tank 40 adjacent to the rear discharge 45.

An alignment structure is preferably utilized for aligning the batch hauler truck 20 with the front end discharge truck mixer 12 as shown in FIGS. 1 and 5 of the drawings. FIGS. 1 through 5 illustrate the usage of a first guide member 70 attached to the rear bumper 26 or other rear structure of the batch hauler truck 20. The first guide member 70 is preferably comprised of a pin structure. A second guide member 72 is attached to the front bumper or other front structure of the front end discharge truck mixer 12 as shown in FIGS. 1 and 5 of the drawings. The second guide member 72 is comprised of a slot or opening that receives the first guide member 70. It can be appreciated that the respective structures of the guide members 70, 72 can be interchanged.

In use, the user fills the first reservoir 44 with the desired particulate material 11 and the second reservoir 48 with cement 13 and other related material at a filling site. The user then drives the batch hauler truck 20 to the job site and is aligned with a front end discharge truck mixer 12 as shown in FIG. 1 of the drawings. The user then elevates the front of the storage tank 40 by extending the main actuator 50 as shown in FIG. 5 of the drawings. The user then opens the gate member 49 and then actuates the augers 60, 62. The second auger 62 draws the concrete through the middle opening into the first reservoir 44 with the particulate material 11 as shown in FIG. 5 of the drawings. The first auger 60 then transfers the combined particulate material 11 and concrete outwardly through the rear discharge 45 into the front discharge 16 of the front end discharge truck mixer 12 as further shown in FIG. 5 of the drawings. This process continues until the first reservoir 44 and the second reservoir 48 are emptied. The front end discharge truck mixer 12 preferably has the mixing tank 14 in a mixing rotation during the filling thereof and water may be combined with the mixture during and after the filling of the mixing tank 14. The batch hauler truck 20 is then separated from the front end discharge truck mixer 12 allowing the front end discharge truck mixer 12 to mix the concrete mixture and dispense the same upon the job site. Once the front end discharge truck mixer 12 has dispenses the concrete mixture, the entire process is repeated with another batch hauler truck 20 at the job site.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A batch hauler truck for transporting concrete mixing material to a job site for a truck mixer, comprising:

a frame and wheels;

a support structure extending upwardly from a rear portion of said frame;

a storage tank pivotally attached to said support structure, wherein said storage tank has a first reservoir for storing a volume of particulate material, a second reservoir for storing a volume of cement, a reservoir opening between said reservoirs, a gate member selectively closing said reservoir opening and a rear discharge opening; and a main actuator connected between said frame and said storage tank for elevating said storage tank.

2. The batch hauler truck of claim 1, including a first auger within said first reservoir for dispensing said particulate material through said rear discharge opening.

3. The batch hauler truck of claim 2, including a second auger within said second reservoir for discharging said cement through said reservoir opening into said first reservoir.

4. The batch hauler truck of claim 1, including a first opening within said storage tank providing access to said first reservoir, and a second opening within said storage tank providing access to said second reservoir.

5. The batch hauler truck of claim 4, including a first hatch and a second hatch for selectively enclosing said first opening and said second opening respectively.

6. The batch hauler truck of claim 1, wherein said main actuator is hydraulically powered by a hydraulic system upon a truck mixer.

7. The batch hauler truck of claim 1, wherein said first reservoir has a larger volume than said second reservoir.

8. The batch hauler truck of claim 7, wherein said first reservoir surrounds said second reservoir.

9. The batch hauler truck of claim 1, wherein said gate member is manually manipulated.

10. The batch hauler truck of claim 1, wherein said gate member is mechanically manipulated by an actuator.

11. A batch hauler truck for transporting concrete mixing material to a job site for a truck mixer, comprising:

a frame and wheels;

a support structure extending upwardly from a rear portion of said frame;

a storage tank pivotally attached to said support structure, wherein said storage tank has a first reservoir for storing a volume of particulate material, a second reservoir for storing a volume of cement, a reservoir opening between said reservoirs, a gate member selectively closing said reservoir opening and a rear discharge opening;

a main actuator connected between said frame and said storage tank for elevating said storage tank;

a first guide member attached to a rear portion of said batch hauler truck; and a second guide member attachable to a front portion of a truck mixer, wherein said first guide member and said second guide member are positionable within one another for providing alignment of the trucks.

12. The batch hauler truck of claim 11, including a first auger within said first reservoir for dispensing said particulate material through said rear discharge opening.

13. The batch hauler truck of claim 12, including a second auger within said second reservoir for discharging said cement through said reservoir opening into said first reservoir.

14. The batch hauler truck of claim 11, including a first opening within said storage tank providing access to said first reservoir, and a second opening within said storage tank providing access to said second reservoir.

15. The batch hauler truck of claim 14, including a first hatch and a second hatch for selectively enclosing said first opening and said second opening respectively.

16. The batch hauler truck of claim 11, wherein said main actuator is hydraulically powered by a hydraulic system upon a truck mixer.

17. The batch hauler truck of claim 11, wherein said first reservoir has a larger volume than said second reservoir.

18. The batch hauler truck of claim 17, wherein said first reservoir surrounds said second reservoir.

19. The batch hauler truck of claim 11, wherein said gate member is manually manipulated.

20. A method of operating a batch hauler truck for refilling a truck mixer with a concrete mixture at a job site, wherein said batch hauler truck is comprised of a frame and wheels, a support structure extending upwardly from a rear portion of said frame, a storage tank pivotally attached to said support structure, wherein said storage tank has a first reservoir, a second reservoir, a reservoir opening between said reservoirs, a gate member selectively closing said reservoir opening and a rear discharge opening, a main actuator connected between said frame and said storage tank for elevating said storage tank, said method comprising the steps of:

(a) filling said first reservoir with a volume of particulate material;

(b) filling said second reservoir with a volume of cement;

(c) operating said batch hauler truck to said job site;

(d) aligning said batch hauler truck such that said rear discharge opening is near a front discharge opening of said truck mixer;

(e) elevating said storage tank;

(f) opening said gate member;

(g) facilitating dispensing of said cement from said second reservoir into said first reservoir; and (h) facilitating dispensing of said particulate material with said cement through said rear discharge opening into said front discharge opening.

* * * * *